US007384234B2

(12) United States Patent
Petersen et al.

(10) Patent No.: US 7,384,234 B2
(45) Date of Patent: Jun. 10, 2008

(54) SYSTEM AND METHOD FOR MOUNTING A FAN SHROUD

(75) Inventors: Chad Petersen, Jackson, MN (US); Muhammad Chandasir, Jackson, MN (US)

(73) Assignee: AGCO Corp., Duluth, GA (US)

( * ) Notice: Subject to any disclaimer, the term of this patent is extended or adjusted under 35 U.S.C. 154(b) by 146 days.

(21) Appl. No.: 11/278,331

(22) Filed: Mar. 31, 2006

(65) Prior Publication Data

US 2007/0231126 A1 Oct. 4, 2007

(51) Int. Cl.
*F01D 25/28* (2006.01)

(52) U.S. Cl. ..... 415/1; 415/213.1; 415/214.1

(58) Field of Classification Search ..... 415/213.1, 415/214.1, 228, 173.1, 1; 416/189, 169 A
See application file for complete search history.

(56) References Cited

U.S. PATENT DOCUMENTS 4,018,297 A * 4/1977 Haupt ..... 180/68.1
4,522,160 A * 6/1985 Speers et al. ..... 123/41.49
4,552,160 A * 11/1985 Griggs ..... 132/73
5,623,893 A 4/1997 Bartz
6,146,071 A * 11/2000 Norkus et al. ..... 411/104

* cited by examiner

*Primary Examiner*—Edward Look
*Assistant Examiner*—Asefeh Hemmati
(74) *Attorney, Agent, or Firm*—Ryan A. Schneider, Esq.; Troutman Sanders LLP

(57) ABSTRACT

A system for mounting a fan shroud to a radiator assembly comprises a fan shroud having a general profile defining at least one fan shroud slot aligned along a first axis. A fan shroud mount is carried by the radiator assembly. The fan shroud mount has a general profile defining at least one fan shroud mount slot aligned along a second axis which is perpendicular to the first axis of the fan shroud slot. A cage nut is utilized for mounting the fan shroud with the fan shroud mount. The fan shroud slot and the fan shroud mount slot are designed for overlapping orientation. This overlapping orientation enables the fan shroud fastener to be simultaneously received within the fan shroud slot and the fan shroud mount slot. In operation, the fan shroud fastener may move along either the first axis or the second axis for positioning the fan shroud at a desired horizontal and vertical location with respect to the radiator assembly.

10 Claims, 3 Drawing Sheets

SYSTEM AND METHOD FOR MOUNTING A FAN SHROUD

TECHNICAL FIELD

The present invention generally relates to a system and method for mounting a fan shroud and more particularly to a mounting system which includes a horizontal slot communicating and overlapping with a vertical slot which enables the shroud to have a full range of motion when attached to a radiator assembly for facilitating in the attachment of a motor assembly having a fan.

BACKGROUND

Heavy industrial machines including farm application systems are typically very large machines which operate under heavy loads. Such machines are typically constructed and assembled via separate subassemblies. One such subassembly is the motor which includes a front mounted fan for certain operation requirements. An additional subassembly is the radiator/cooling assembly. Both of these subassemblies are intended to be mated such that the fan facilitates in drawing air through the radiator assembly for facilitating in the cooling of the engine. Additionally, it is common to include a fan shroud which is part of the radiator/cooling assembly and which is intended for surrounding the fan for increasing the efficiency and reducing the sound of the operation of the fan.

A critical feature of the manufacturing of these subassemblies including the fan shroud is the tolerances which must be observed in the manufacturing. In order to maximize the performance of the fan, it is desirable to have the fan mounted very precisely within the shroud. However, it is typical to have the shroud fixedly attached to the radiator/cooling assembly. Consequently, if either the radiator/cooling subassembly or engine assembly are slightly off-centered on the chassis of the machine, it is extremely difficult to mate the fan within the shroud under the necessary tolerances.

Such tolerances are critical to the performance and reliability of the machine. Not only does the shroud facilitate in improving the fan's efficiency, but the clearance between the shroud and fan is necessary to compensate for any movement of the engine which may occur during operation of the machine. Since the fan is connected to the engine, movement of the engine results in relative movement of the fan blade relative to the shroud. Consequently, interference may exist which will damage the fan blades.

U.S. Pat. No. 5,623,893 provides one solution to integrating the respective subassemblies. However, such a design while suitable for its intended purpose utilizes one set of hardware to accomplish vertical adjustability and another complete set of hardware and a second plane of sheet material to accomplish horizontal adjustability. While such a design may work sufficiently, it appears to be complex and cumbersome for an installer to perform during manufacturing of the machine, and also would most likely be expensive to build.

Accordingly, there is a need to ensure that the fan is mounted accurately within the shroud during manufacturing utilizing a simple system which facilitates the ease of assembly for an installer during the manufacturing process and also requires limited parts to limit costs. The present invention is directed to overcoming problems associated with mounting the fan blades with respect to the shroud.

BRIEF SUMMARY

A system for mounting a fan shroud to a radiator assembly comprises a fan shroud having a general profile defining at least one fan shroud slot aligned along a first axis. A fan shroud mount is carried by the radiator assembly. The fan shroud mount has a general profile defining at least one fan shroud mount slot aligned along a second axis which is perpendicular to the first axis of the fan shroud slot. A cage nut is utilized for mounting the fan shroud with the fan shroud mount. The fan shroud slot and the fan shroud mount slot are designed for overlapping orientation. This overlapping orientation enables the fan shroud fastener to be simultaneously received within the fan shroud slot and the fan shroud mount slot. In operation, the fan shroud fastener may move along either the first axis or the second axis for positioning the fan shroud at a desired horizontal and vertical location with respect to the radiator assembly.

BRIEF DESCRIPTION OF THE DRAWINGS

The methods and system designed to carry out the invention will hereinafter be described, together with other features thereof.

The invention will be more readily understood from a reading of the following specification and by reference to the accompanying drawings forming a part thereof.

DETAILED DESCRIPTION OF PREFERRED AND ALTERNATIVE EMBODIMENTS

Figure 1:
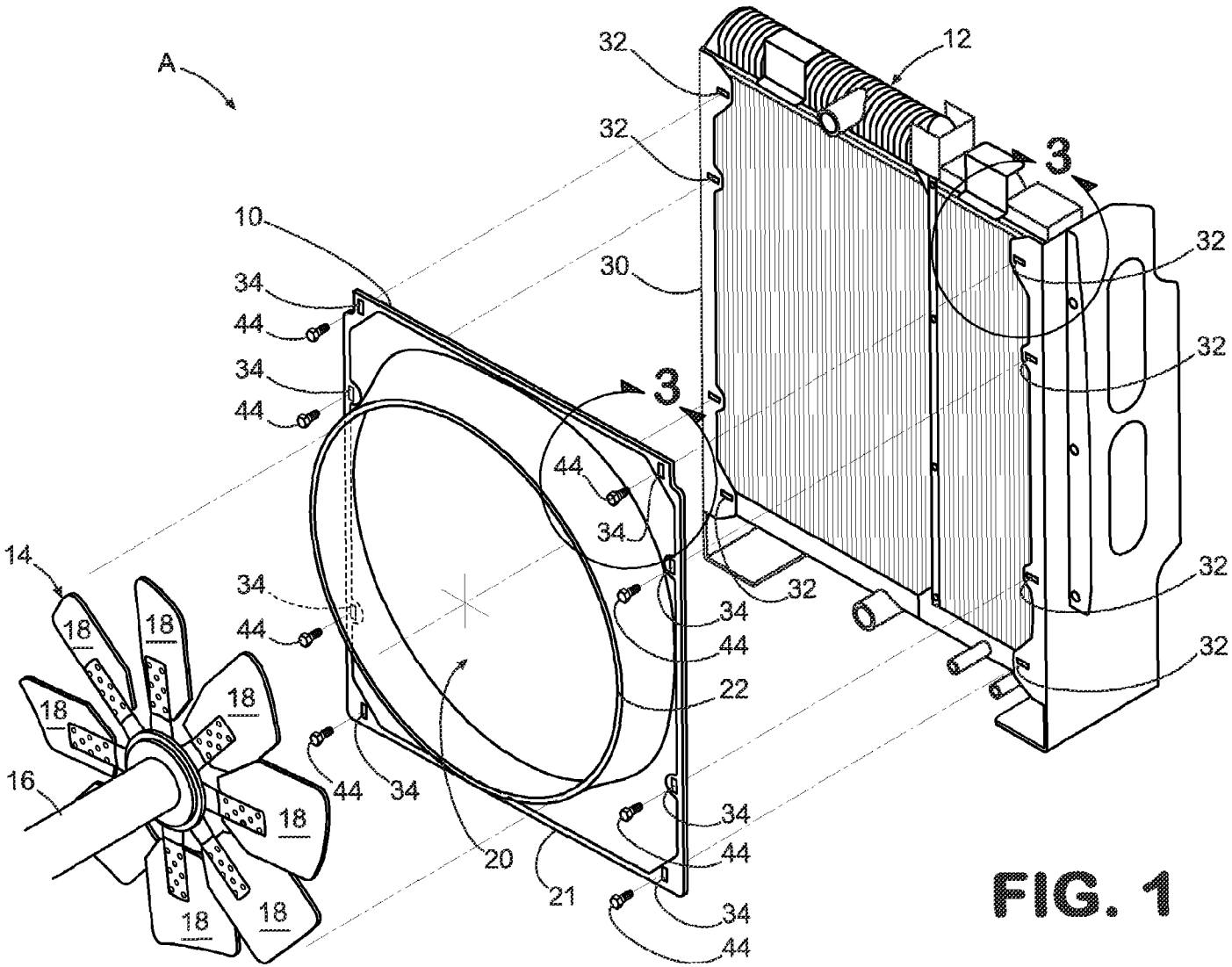
FIG. 1 is an exploded view illustrating a fan shroud assembly system according to the present invention.

Referring now in more detail to the drawings, the invention will now be described in more detail. As shown in FIG. 1, a fan shroud mounting system A is utilized for mounting fan shroud 10 with a radiator assembly 12 during a manufacturing assembly process. Radiator assembly 12 is typically affixed to a frame subassembly which is subsequently mounted onto a chassis no shown. Fan 14 is associated with an engine subassembly (not shown) which is also mounted onto a chassis. In operation, fan shaft 16 shaft defines a central rotational axis for rotation of the fan. It is desired for shroud 10 be positioned with respect to the central rotational axis such that fan blades 18 are mounted within desired manufacturing tolerances such that a clearance exist between the fan blades 18 and the central interior 20 of fan shroud 10.

Figure 2:
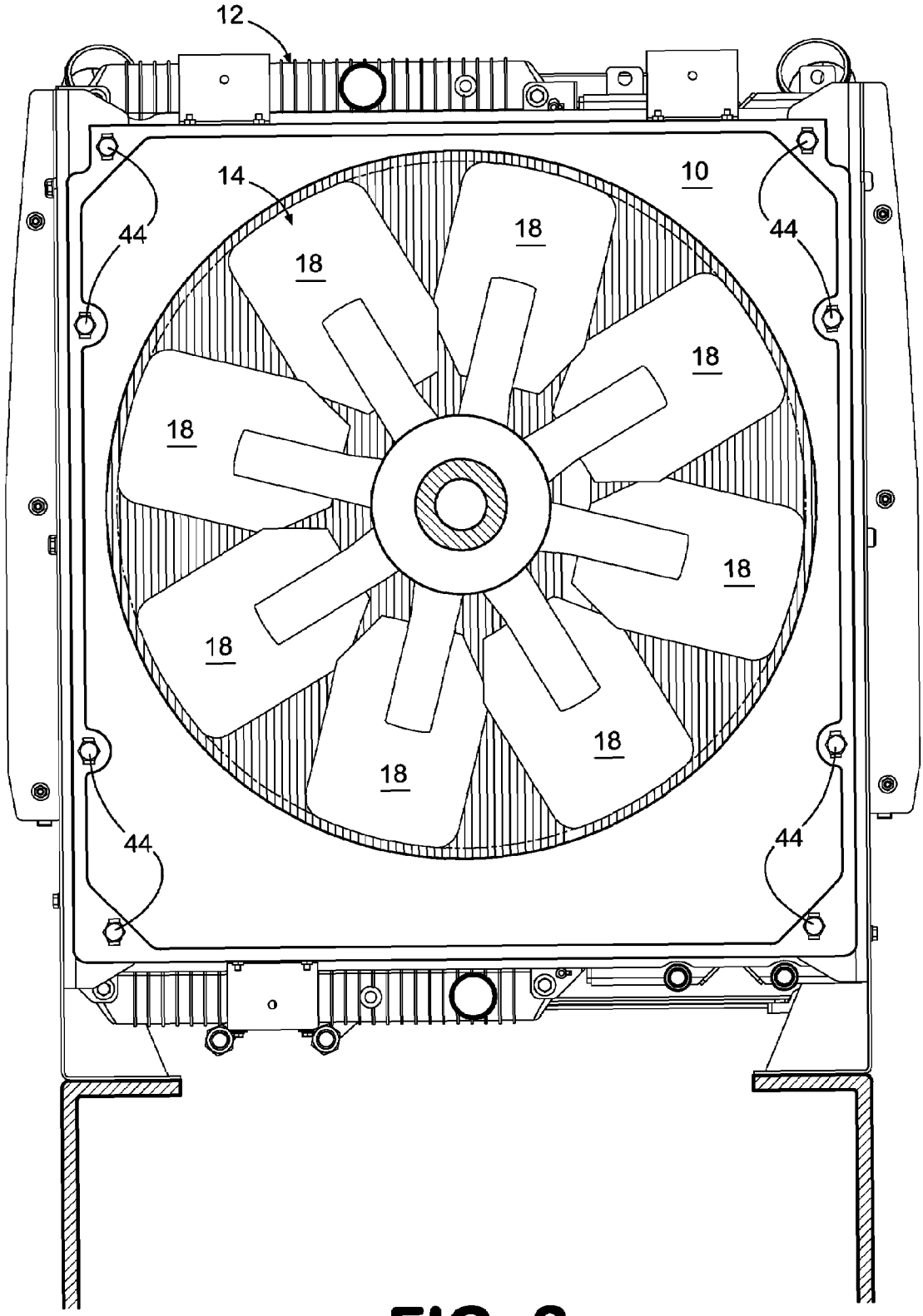
FIG. 2 identifies a completed assembly illustrating the positioning of a fan shroud with respect to a radiator assembly and engine fan.

FIG. 2 illustrates the assembled engine and radiator subassemblies with fan shroud 10 being aligned with fan 14. Misalignment is typical in a manufacturing system due to the rigidly affixed engine to the engine subassembly and the radiator to the cooling subassembly. Accordingly, when the fan is received by the fan shroud, errors in the positioning of either the fan shroud as a component of the radiator assembly and the fan as a component of the engine assembly may occur due to the fixed nature of both components. As shown in FIG. 2, it is desirable that fan 14 is received within fan shroud 10, if the central axis as defined by the shaft of the fan is not centrally received within fan shroud 10, then the proximity of fan blades 18 with the interior of fan shroud 10 varies with certain clearances between respective fan blades and the fan shroud being too tight for acceptable machine operation. Applicant's invention provides for a simple and effective system and method for ensuring the concentric alignment of the fan and shroud.

FIG. 1 illustrates one embodiment of the system. Fan shroud 10 preferably includes a fiber glass body 21 which carries fan shroud hood 22. Fan shroud hood 22 is conical in shape having a larger diameter on the radiator side than on the fan side. In operation, fan 14 typically has a thirty-eight inch diameter and the fan sided end of the fan shroud hood is thirty-nine inches in diameter. The conical shape of the fan shroud hood 22 facilitates in the drawing of air from the larger radiator surface area. Also, it is desired that when fan blades 18 are received within the fan shroud, that the fan blades are half way in and half way out. Accordingly, it is desired to have axis to axis alignment between the fan shaft and the center of the fan shroud.

Figure 3:
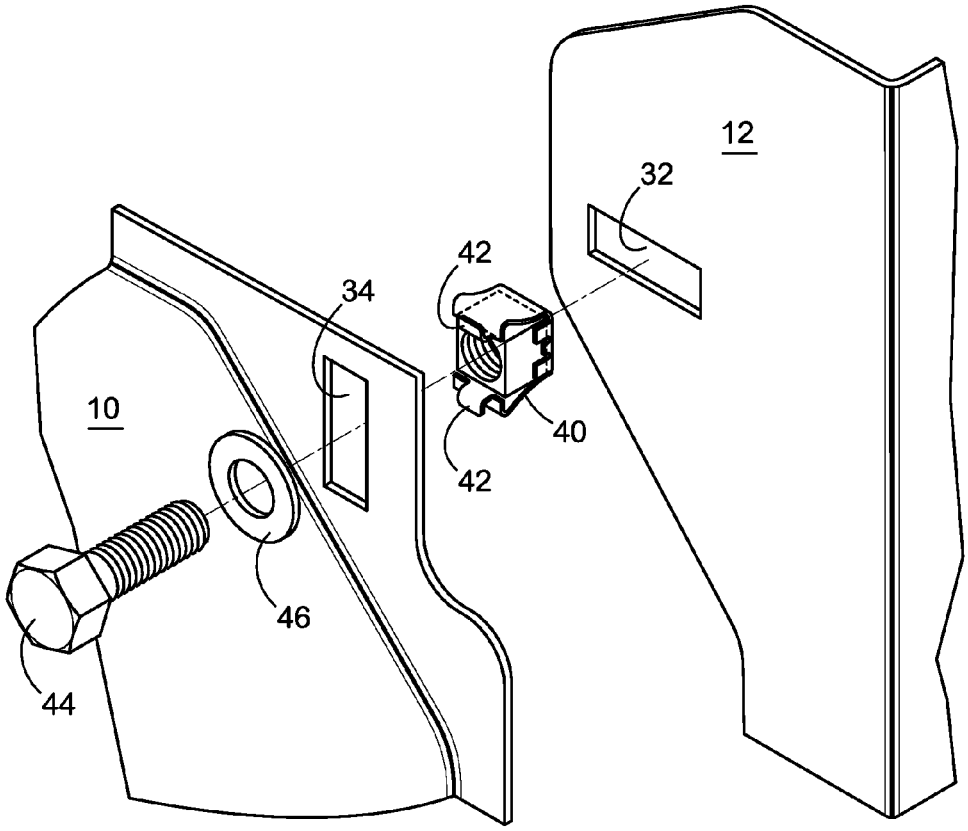
FIG. 3 is an exploded perspective view taken at inset circle 3 in FIG. 1.
Figure 4:
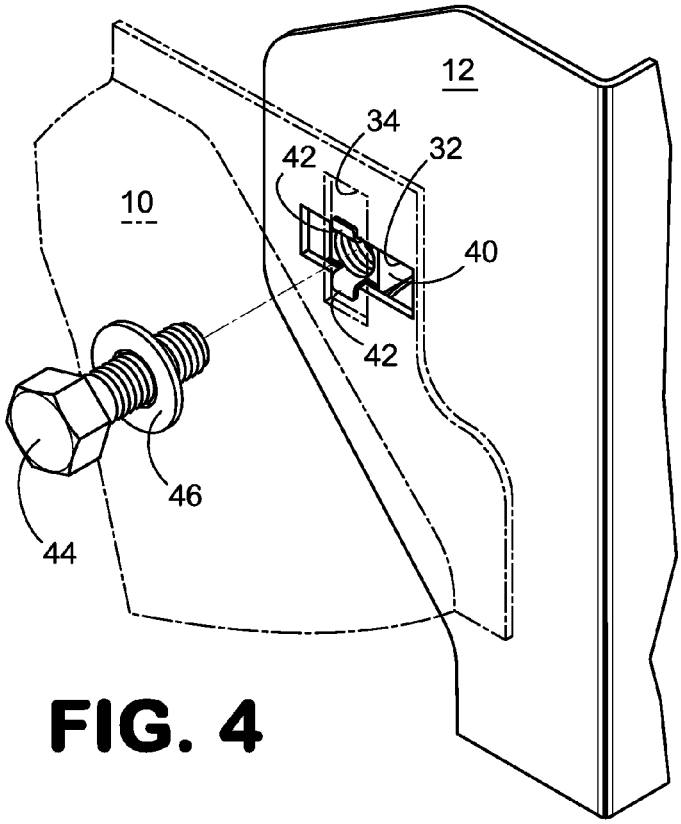
FIG. 4 is a perspective view, similar to FIG. 3 showing a cage nut received within the horizontal slot of the radiator mounting frame in position for receiving a bolt according to one aspect of the present invention.

As shown in FIG. 1 and further illustrated in close-up view in FIG. 3 and FIG. 4, radiator assembly 12 includes fan shroud mount 30. Fan shroud mount 30 may be integral with the frame of a radiator, or may be a distinctive mount attached to the radiator assembly. Fan shroud mount 30 includes fan shroud mount slots 32. Fan shroud mount slots 32 are orientated in a first axial direction. As shown in these respective figures, fan shroud mount slots 32 are orientated in a horizontal direction. Fan shroud 10 includes a set of fan shroud slots 34. Fan shroud slots 34 are orientated in a second axial direction perpendicular to the first axial direction of fan shroud mount slots 32. As shown in these respective figures, fan shroud mount slots 34 are orientated in a vertical direction.

FIGS. 3 and 4 show a critical aspect of the invention, captive hardware 40, preferably a cage nut, is inserted and carried by one of the slots. In the best mode, captive hardware 40 is a cage nut. As shown in these figures, the cage nut hardware is carried by fan shroud mount slots 32. Alternatively, in some embodiments, the cage nut hardware may be carried by fan shroud slots 34. By utilizing a cage nut, the assembly operation may be conducted with minimum effort. At a first stage of assembly, a cage nut is inserted into the respective slot. The resilient tabs 42 of the cage nut are received in the respective slot and engage the walls of the fan shroud mount maintaining the cage nut in ready position for receiving a bolt which ultimately secures the fan shroud in position. By having a cage nut in ready position, the operator can then manipulate the fan shroud so fastener 44 may be inserted through the second set of slots associated with the fan shroud for integrating the fan shroud with the radiator assembly. The fastener will simultaneously extend within each slot enabling horizontal and vertical repositioning of the fan shroud. With the fiberglass frame, a washer 46 is utilized for dispersing forces across a larger area for assisting in the prevention of cracking the fiberglass.

Accordingly in operation, the operator inserts the cage nut into position. The fan shroud is initially mounted onto the radiator assembly by the fastener passing through the fan shroud slots and being received by the cage nut. Thus when the fan is positioned within the fan shroud, the fan shroud may be easily moved by an operator in either a vertical or horizontal direction until the fan and fan shroud are in concentric alignment. This method enables an efficient and easy assembly process by an operator while maintaining the required tolerances for operation in the field.

While the various embodiments of this invention have been described in detail with particular reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

We claim:

1. A system for mounting a fan shroud to a radiator assembly comprising:

a fan shroud having a general profile defining at least one fan shroud elongated slot having a length along a first axis;

a fan shroud mount carried by said radiator assembly;

said fan shroud mount having a general profile defining at least one fan shroud mount elongated slot having a length along a second axis which is perpendicular to said first axis;

a cage nut received within said fan shroud mount elongated slot;

a fan shroud fastener;

said fan shroud elongated slot and said fan shroud mount elongated slot being designed for only a portion of each said elongated slot to have an overlapping orientation enabling said fan shroud fastener to be simultaneously received within only a portion of said fan shroud elongated slot and only a portion of said fan shroud mount elongated slot;

wherein said fan shroud fastener may move along either the lengths of said first axis or said second axis for positioning said fan shroud at a desired horizontal and vertical location with respect to said radiator assembly.

2. The system of claim 1 wherein said first axis is a vertical axis and said second axis is a horizontal axis.

3. The system of claim 1 wherein said fan shroud has a conical hood for encircling a fan.

4. The system of claim 1 wherein said fan shroud includes a fiberglass component and said fan shroud elongated slot is defined within said fiberglass component.

5. The system of claim 1 wherein said fan shroud defines a plurality of fan shroud elongated slots and said fan shroud mount defines a plurality of fan shroud mount elongated slots.

6. The system of claim 1 wherein said fan shroud mount includes a mounting bracket integral with said radiator assembly.

7. A method of attaching a fan shroud to a radiator assembly, said method comprising;

providing a fan shroud mount associated with said radiator assembly having a first elongated slot;

providing a fan shroud having a second elongated slot associated with said fan shroud;

said first elongated slot and said second elongated slot being perpendicularly oriented in an overlapping relationship; and positioning a fastener simultaneously through said first and second slot.

8. The method of claim 7 further including moving said fastener along the length of said either or both first and second elongated slot for aligning said shroud with respect to a fan associated with a motor assembly.

9. The method of claim 8 further including fully assembling the fan shroud prior to moving said fastener along the length of said either or both first and second elongated slot for aligning said shroud with respect to a fan associated with a motor assembly.

10. The method of claim 7 further including a plurality of first and second elongated slots associated with said fan shroud mount and said fan shroud respectfully, each said elongated slot of the plurality of first elongated slots being perpendicularly oriented in an overlapping relationship with a corresponding elongated slot of the plurality of said second elongated slots.

* * * * *